United States Patent [19]

Hughes

[11] Patent Number: 4,507,219

[45] Date of Patent: Mar. 26, 1985

[54] STABLE LIQUID DETERGENT COMPOSITIONS

[75] Inventor: Larry J. Hughes, Cincinnati, Ohio

[73] Assignee: The Proctor & Gamble Company, Cincinnati, Ohio

[21] Appl. No.: 615,852

[22] Filed: May 31, 1984

Related U.S. Application Data

[63] Continuation-in-part of Ser. No. 522,915, Aug. 12, 1983, abandoned.

[51] Int. Cl.[3] ..... C11D 1/08; C11D 1/86; C11D 9/46

[52] U.S. Cl. ..... 252/118; 252/117; 252/545; 252/546; 252/547; 252/548; 252/551; 252/552; 252/553; 252/554; 252/555; 252/558; 252/559

[58] Field of Search ..... 252/117, 118, 121, 174.19, 252/547, 545, 546, 548, 550, 551, 552, 553, 554, 558, 559

[56] References Cited

U.S. PATENT DOCUMENTS

| | | | |
|---|---|---|---|
| 3,935,129 | 1/1976 | Jabalee | 252/153 |
| 4,079,078 | 3/1978 | Collins | 252/545 |
| 4,142,999 | 3/1979 | Bloching et al. | 252/544 |
| 4,153,570 | 5/1979 | Hennemann et al. | 252/121 |
| 4,268,262 | 5/1981 | Bechstedt | 8/137 |
| 4,285,841 | 8/1981 | Barrat et al. | 252/559 |
| 4,287,082 | 9/1981 | Tolfo et al. | 252/174.12 |
| 4,302,364 | 11/1981 | Gosset et al. | 252/545 |
| 4,305,837 | 12/1981 | Kaminsky et al. | 252/174.12 |
| 4,318,818 | 3/1982 | Letton et al. | 252/174.12 |
| 4,333,862 | 6/1982 | Smith et al. | 252/547 |
| 4,387,040 | 6/1983 | Straw | 262/368 |
| 4,391,726 | 7/1983 | Koster | 252/99 |
| 4,438,024 | 3/1984 | Del Greco et al. | 252/545 |

FOREIGN PATENT DOCUMENTS

| | | |
|---|---|---|
| 2819455 | 11/1978 | Fed. Rep. of Germany . |
| 53-86707 | 7/1978 | Japan . |

OTHER PUBLICATIONS

U.S. patent application Ser. No. 380,988, Wertz et al., filed May 24, 1982.

U.S. patent application Ser. No. 353,743, Bleil et al., filed Mar. 1, 1982.

U.S. patent application Ser. No. 380,987, Bleil et al., filed May 24, 1982.

*Primary Examiner*—Prince E. Willis

*Attorney, Agent, or Firm*—Donald E. Hasse; Robert B. Aylor; Thomas H. O'Flaherty

[57] ABSTRACT

Heavy-duty liquid detergents containing sulfonate and alcohol ethoxylate sulfate anionic surfactants, ethoxylated nonionic surfactant, optional quaternary ammonium, amine or amine oxide surfactants, saturated fatty acid, polycarboxylate builder, a neutralization system comprising sodium, potassium and preferably low levels of alkanolamines, and a solvent system comprising ethanol, polyol and water. The compositions are isotropic liquids providing a high level of detergency performance and improved chlorine bleach compatibility.

10 Claims, No Drawings

STABLE LIQUID DETERGENT COMPOSITIONS

REFERENCE TO RELATED APPLICATION

This application is a continuation-in-part of U.S. patent application Ser. No. 522,915, filed Aug. 12, 1983, now abandoned.

TECHNICAL FIELD

The present invention relates to heavy-duty liquid detergent compositions containing sulfonate surfactant, alcohol ethoxylate sulfate surfactant, ethoxylated nonionic surfactant, an optional quaternary ammonium, amine or amine oxide surfactant, saturated fatty acid, polycarboxylate builder, a neutralization system comprising sodium, potassium and preferably low levels of alkanolamines, and a solvent system comprising ethanol, polyol and water. The compositions are isotropic liquids which provide a high level of detergency performance and improved chlorine bleach compatibility.

There has been considerable demand for liquid detergents capable of providing superior cleaning under a wide variety of laundering conditions. Such compositions generally require a number of ingredients which tend to separate into discrete phases. Isotropic liquid detergents are desired for both consistency of performance and aesthetic reasons. The compositions should remain isotropic during shipping and storage, where temperatures of 55° F. (12.8° C.) or lower are often encountered. They preferably are also formulated to recover, after freezing and thawing, to an isotropic phase prior to consumer use.

Liquid detergents often contain high levels of alkanolamines to enhance performance and product stability. However, alkanolamines readily react with and destroy chlorine bleaches. Consumers who add chlorine bleaches to wash solutions containing alkanolamine-based detergents consequently do not obtain optimum bleaching performance. Thus, there is a continuing need for the development of a liquid detergent capable of providing superior cleaning, bleach compatibility and product stability.

BACKGROUND ART

Pending U.S. patent application Ser. No. 380,988, Wertz et al, filed May 24, 1982, now abandoned, discloses detergent compositions containing anionic surfactants, quaternary ammonium, amine or amine oxide surfactants, and fatty acids, and formulated to provide a near-neutral wash pH. The compositions are preferably liquid detergents which additionally contain ethoxylated nonionic surfactants and polycarboxylate builders.

U.S. Pat. No. 4,285,841, Barrat et al, issued Aug. 25, 1981, discloses liquid detergents containing anionic surfactants, nonionic surfactants and from about 8% to about 20% by weight of a fatty acid. The compositions have a pH of from about 6.0 to about 7.5.

U.S. Pat. No. 4,287,082, Tolfo et al, issued Sept. 1, 1981, discloses liquid detergents containing saturated fatty acids, enzymes, enzyme-accessible calcium and short-chain carboxylic acid salts, preferably formates.

SUMMARY OF THE INVENTION

The present invention encompasses heavy-duty liquid detergent compositions comprising, by weight:

(a) from about 5% to about 15%, on an acid basis, of a sulfonate surfactant containing a $C_{10}$–$C_{16}$ alkyl or alkenyl group;

(b) from about 8% to about 18%, on an acid basis, of an alcohol ethoxylate sulfate surfactant of the formula $RO(C_2H_4O)_mSO_3M$, wherein R is a $C_{10}$–$C_{16}$ alkyl or hydroxyalkyl group, m is from about 0.5 to about 4, and M is a compatible cation;

(c) from about 2% to about 15% of an ethoxylated nonionic surfactant of the formula $R^1(OC_2H_4)_nOH$, wherein $R^1$ is a $C_{10}$–$C_{16}$ alkyl group or a $C_8$–$C_{12}$ alkyl phenyl group, n is from about 3 to about 9, and said nonionic surfactant has an HLB of from about 10 to about 13;

(d) from about 0% to about 5% of a cosurfactant selected from the group consisting of:

(i) quaternary ammonium surfactants having the formula:

$$[R^2(OR^3)_y][R^4(OR^3)_y]_2R^5N^+X^-$$

wherein $R^2$ is an alkyl or alkyl benzyl group having from about 6 to about 16 carbon atoms in the alkyl chain; each $R^3$ is selected from the group consisting of —$CH_2CH_2$—, —$CH_2CH(CH_3)$—, —$CH_2CH(CH_2OH)$—, —$CH_2CH_2CH_2$—, and mixtures thereof; each $R^4$ is selected from the group consisting of $C_1$–$C_4$ alkyl, $C_1$–$C_4$ hydroxyalkyl, benzyl, and hydrogen when y is not 0; $R^5$ is the same as $R^4$ or is an alkyl chain wherein the total number of carbon atoms of $R^2$ plus $R^5$ is from about 8 to about 16; each y is from 0 to about 10 and the sum of the y values is from 0 to about 15; and X is any compatible anion;

(ii) amine surfactants having the formula:

$$[R^2(OR^3)_y][R^4(OR^3)_y]R^5N$$

wherein $R^2$, $R^3$, $R^4$, $R^5$ and y are as defined above;

(iii) amine oxide surfactants having the formula:

$$[R^2(OR^3)_y][R^4(OR^3)_y]R^5N\rightarrow 0$$

wherein $R^2$, $R^3$, $R^4$, $R^5$ and y are as defined above;

(e) from about 5% to about 20% of a $C_{10}$–$C_{14}$ saturated fatty acid, the weight ratio of $C_{10}$–$C_{12}$ fatty acid to $C_{14}$ fatty acid being at least 1;

(f) from about 3% to about 8%, on an acid basis, of a water-soluble polycarboxylate builder material;

(g) from about 0 to about 0.04 moles per 100 grams of composition of an alkanolamine selected from the group consisting of monoethanolamine, diethanolamine and triethanolamine;

(h) potassium and sodium ions in a potassium to sodium molar ratio of from about 0.1 to about 1.3;

(i) from about 2% to about 10% ethanol;

(j) from about 2% to about 15% of a polyol containing from 2 to 6 carbon atoms and from 2 to 6 hydroxy groups; and (k) from about 25% to about 40% water;

said composition containing from about 20% to about 35% of (a), (b), (c) and (d); from about 8% to about 28% of (e) and (f); from about 33% to about 50% of (a), (b), (c), (d), (e) and (f); from about 8% to about 20% of (i) and (j); and from about 35% to about 55% of (i), (j) and (k); the weight ratio of (a) to (b) being from about 0.3 to about 1.7; the weight ratio of (a) plus (b) to (c) being from about 1 to about 10; and all of said components being selected to provide an isotropic liquid at 55° F. (12.8° C.) having an initial pH of from about 7.5 to about 9.0 at a concentration of about 10% by weight in water at 68° F. (20° C.).

DETAILED DESCRIPTION OF THE INVENTION

The liquid detergent of the present invention contain sulfonate and alcohol ethoxylate sulfate anionic surfactants, ethoxylated nonionic surfactant, optional quaternary ammonium, amine or amine oxide surfactants, saturated fatty acid, polycarboxylate builder, a neutralization system comprising sodium, potassium and preferably low levels of alkanolamines, and a solvent system comprising ethanol, polyol and water.

The compositions herein are formulated to provide a high level of detergency performance under a wide variety of laundering conditions. They also provide improved chlorine bleach compatibility due to the limited amount of alkanolamines. Since the compositions contain a relatively high level of active components and little or no alkanolamine to enhance product stability, the types, levels and ratios of the components must be carefully balanced to provide isotropic liquids at 55° F. (12.8° C.). Preferred compositions herein are isotropic liquids at 50° F. (10° C.). They preferably also recover, after freezing and thawing, to an isotropic form by 55° F. (12.8° C.), more preferably by 50° F. (10° C.).

In order to meet these stability constraints, the present compositions require a neutralization system comprising mixed potassium and sodium ions. Complete sodium neutralization causes crystallization of the polycarboxylate builder, whereas all potassium neutralization results in an unacceptably high gel point. The total level of organic and inorganic bases must also be selected to provide a sufficiently high product pH to minimize the level of poorly-soluble free fatty acids, without being so high that pH sensitive strain removal, enzyme stability, and greasy/oily soil removal are compromised.

The compositions also require a solvent system comprising water and a mixture of ethanol and polyol. Crystallization occurs without the polyol and unacceptably high gel points are obtained without the ethanol. The amount of ethanol and polyol must also be sufficient to prevent organic phase separation (i.e., keep free fatty acids and poorly-soluble surfactants in solution), and yet not be so high as to cause lye phase separation and/or crystallization by limiting the amount of water available.

SULFONATE SURFACTANT

The detergent compositions herein contain from about 5% to about 15%, preferably from about 6% to about 10%, by weight (on an acid basis) of an anionic sulfonate surfactant containing a $C_{10}$–$C_{16}$ alkyl or alkenyl group. Anionic sulfonate surfactants useful herein are disclosed in U.S. Pat. No. 4,285,841, Barrat et al, issued Aug. 25, 1981, and in U.S. Pat. No. 3,919,678, Laughlin et al, issued Dec. 30, 1975, both incorporated herein by reference.

Preferred sulfonate surfactants are the water-soluble salts, particularly the alkali metal, and alkanolammonium (e.g., monoethanolammonium or triethanolammonium) salts of alkylbenzene sulfonates in which the alkyl group contains from about 10 to about 15 carbon atoms, in straight chain or branched chain configuration, e.g., those of the type described in U.S. Pat. Nos. 2,220,099 and 2,477,383, incorporated herein by reference. Especially valuable are linear straight chain alkylbenzene sulfonates in which the average number of carbon atoms in the alkyl group is from about 11 to about 13.

Also useful herein are the water-soluble salts of paraffin sulfonates, olefin sulfonates, alkyl glyceryl ether sulfonates, esters of $\alpha$-sulfonated fatty acids containing from about 1 to 10 carbon atoms in the ester group, 2-acyloxy-alkane-1-sulfonates containing from about 2 to 9 carbon atoms in the acyl group, and $\beta$-alkyloxy alkane sulfonates containing from about 1 to 3 carbon atoms in the alkyl group.

Mixtures of the above-described sulfonates, particularly with the $C_{11-13}$ linear alkylbenzene sulfonates, can also be used.

ALCOHOL ETHOXYLATE SULFATE SURFACTANT

The present compositions also contain an alcohol ethoxylate sulfate surfactant of the formula $RO(C_2H_4O)_mSO_3M$, wherein R is a $C_{10}$–$C_{16}$ alkyl (preferred) or hydroxyalkyl group, m is from about 0.5 to about 4, and M is a compatible cation. This surfactant represents from about 8% to about 18%, preferably from about 9% to about 14%, by weight (on an acid basis) of the composition.

Preferred alcohol ethoxylate sulfate surfactants of the above formula are those wherein the R substituent is a $C_{12-15}$ alkyl group and m is from about 1.5 to about 3. Examples of such materials are $C_{12-15}$ alkyl polyethoxylate (2.25) sulfate ($C_{12-15}$ $E_{2.25}S$); $C_{14-15}E_{2.25}S$; $C_{12-13}E_{1.5}S$; $C_{14-15}E_3S$; and mixtures thereof. The sodium, potassium, monoethanolammonium, and triethanolammonium salts of the above are preferred.

ETHOXYLATED NONIONIC SURFACTANT

The compositions also contain from about 2% to about 15%, preferably from about 4% to about 10%, by weight of an ethoxylated nonionic surfactant of the formula $R^1(OC_2H_4)_nOH$, wherein $R^1$ is a $C_{10}$–$C_{16}$ alkyl group or a $C_8$–$C_{12}$ alkyl phenyl group, n is from about 3 to about 9, and said nonionic surfactant has an HLB (hydrophile-lipophile balance) of from about 10 to about 13. These surfactants are more fully described in U.S. Pat. Nos. 4,285,841, Barrat et al, issued Aug. 25, 1981, and 4,284,532, Leikhim et al, issued Aug. 18, 1981, both incorporated herein by reference. Particularly preferred are condensation products of $C_{12}$–$C_{14}$ alcohols with from about 3 to about 7 moles of ethylene oxide per mole of alcohol, e.g., $C_{12}$–$C_{13}$ alcohol condensed with about 6.5 moles of ethylene oxide per mole of alcohol.

COSURFACTANT

The compositions herein can contain from about 0% to about 5%, preferably from about 0.5% to about 3%, by weight of a cosurfactant selected from certain quaternary ammonium, amine, and amine oxide surfactants. The quaternary ammonium surfactants are particularly preferred.

The quaternary ammonium surfactants useful herein are of the formula:

$$[R^2(OR^3)_y][R^4(OR^3)_y]_2R^5N^+X^-$$

wherein $R^2$ is an alkyl or alkyl benzyl group having from about 6 to about 16 carbon atoms in the alkyl chain; each $R^3$ is selected from the group consisting of $-CH_2CH_2-$, $-CH_2CH(CH_3)-$, $-CH_2CH(CH_2OH)-$, $-CH_2CH_2CH_2-$, and mixtures thereof; each $R^4$ is selected from the group consisting of $C_1$–$C_4$ alkyl, $C_1$–$C_4$ hydroxyalkyl, benzyl, and hydrogen when y is not 0; $R^5$ is the same as $R^4$ or is an alkyl chain wherein the total number of carbon atoms of $R^2$ plus $R^5$ is from about 8 to about 16; each y is from 0 to about 10 and the sum of the y values is from 0 to about 15; and X is any compatible anion.

Preferred of the above are the alkyl quaternary ammonium surfactants, especially the mono-long chain alkyl surfactants described in the above formula when $R^5$ is selected from the same groups as $R^4$. The most preferred quaternary ammonium surfactants are the chloride, bromide and methylsulfate $C_{8-16}$ alkyl trimethylammonium salts, $C_{8-16}$ alkyl di(hydroxyethyl)methylammonium salts, the $C_{8-16}$ alkyl hydroxyethyldimethylammonium salts, $C_{8-16}$ alkyloxypropyl trimethylammonium salts, and the $C_{8-16}$ alkyloxypropyl dihydroxyethylmethylammonium salts. Of the above, the $C_{10}$–$C_{14}$ alkyl trimethylammonium salts are preferred, e.g., decyl trimethylammonium methylsulfate, lauryl trimethylammonium chloride, myristyl trimethylammonium bromide and coconut trimethylammonium chloride and methylsulfate.

Under cold water washing conditions, i.e., less than about 65° F. (18.3° C.), the $C_{8-10}$ alkyl trimethylammonium surfactants are particularly preferred since they have lower Kraft boundaries and crystallization temperatures than the longer chain quaternary ammonium surfactants.

Amine surfactants useful herein are of the formula:

$$[R^2(OR^3)_y][R^4(OR^3)_y]R^5N$$

wherein the $R^2$, $R^3$, $R^4$, $R^5$ and y substituents are as defined above for the quaternary ammonium surfactants. Particularly preferred are the $C_{12-16}$ alkyl dimethyl amines.

Amine oxide surfactants useful herein are of the formula:

$$[R^2(OR^3)_y][R^4(OR^3)_y]R^5N\rightarrow 0$$

wherein the $R^2$, $R^3$, $R^4$, $R^5$ and y substituents are also as defined above for the quaternary ammonium surfactants. Particularly preferred are the $C_{12-16}$ alkyl dimethyl amine oxides.

Amine and amine oxide surfactants are preferably used at higher levels than the quaternary ammonium surfactants since they are only partially protonated in the present systems. For example, preferred compositions herein can contain from about 0.5% to about 1.5% of the quaternary ammonium surfactant, or from about 1% to about 3% of the amine or amine oxide surfactants.

FATTY ACID

The compositions of the present invention contain from about 5% to about 20%, preferably from about 8% to about 18%, most preferably from about 10% to about 16%, by weight of a saturated fatty acid containing from about 10 to about 14 carbon atoms. In addition, the weight ratio of $C_{10}$–$C_{12}$ fatty acid to $C_{14}$ fatty acid should be at least 1, preferably at least 1.5.

Suitable saturated fatty acids can be obtained from natural sources such as plant or animal esters (e.g., palm kernel oil, palm oil and coconut oil) or synthetically prepared (e.g., via the oxidation of petroleum or by hydrogenation of carbon monoxide via the Fisher-Tropsch process). Examples of suitable saturated fatty acids for use in the compositions of this invention include capric, lauric, myristic, coconut and palm kernel fatty acid. Preferred are saturated coconut fatty acids, from about 5:1 to 1:1 (preferably about 3:1) weight ratio mixtures of lauric and myristic acid, mixtures of the above with minor amounts (e.g., 10%–50% of total fatty acid) of oleic acid; and palm kernel fatty acid.

POLYCARBOXYLATE BUILDER

The compositions herein also contain from about 3% to about 8%, preferably from about 3% to about 6%, more preferably from about 3.5% to about 5% by weight on an acid basis, of a water-soluble polycarboxylate detergent builder material. Polycarboxylate builders are described in U.S. Pat. No. 4,284,532, Leikhim et al, issued Aug. 18, 1981, incorporated herein by reference.

The various aminopolycarboxylates, cycloalkane polycarboxylates, ether polycarboxylates, alkyl polycarboxylates, epoxy polycarboxylates, tetrahydrofuran polycarboxylates, benzene polycarboxylates, and polyacetal polycarboxylates are suitable for use herein.

Examples of such polycarboxylate builders are sodium and potassium ethylenediaminetetraacetate; sodium and potassium nitrilotriacetate; the water-soluble salts of phytic acid, e.g., sodium and potassium phytates, disclosed in U.S. Pat. No. 1,739,942, Eckey, issued Mar. 27, 1956, incorporated herein by reference; the polycarboxylate materials described in U.S. Pat. No. 3,364,103, incorporated herein by reference; and the water-soluble salts of polycarboxylate polymers and copolymers described in U.S. Pat. No. 3,308,067, Diehl, issued Mar. 7, 1967, incorporated herein by reference.

Useful detergent builders also include the water-soluble salts of polymeric aliphatic polycarboxylic acids having the following structural and physical characteristics:

(a) a minimum molecular weight of about 350 calculated as to the acid form; (b) an equivalent weight of about 50 to about 80 calculated as to acid form; (3) at least 45 mole percent of the monomeric species having at least two carboxyl radicals separated from each other by not more than two carbon atoms; (d) the site of attachment of the polymer chain of any carboxyl-containing radical being separated by not more than three carbon atoms along the polymer chain from the site of attachment of the next carboxyl-containing radical. Specific examples of such builders are the polymers and copolymers of itaconic acid, aconitic acid, maleic acid, mesaconic acid, fumaric acid, methylene malonic acid, and citraconic acid.

Other suitable polycarboxylate builders include the water-soluble salts, especially the sodium and potassium salts, of mellitic acid, citric acid, pyromellitic acid, benzene pentacarboxylic acid, oxydiacetic acid, carboxymethyloxysuccinic acid, carboxymethyloxymalonic acid, cis-cyclohexanehexacarboxylic acid, cis-cyclopentanetetracarboxylic acid and oxydisuccinic acid.

Other polycarboxylates for use herein are the polyacetal carboxylates described in U.S. Pat. No. 4,144,226, issued Mar. 13, 1979 to Crutchfield et al, and U.S. Pat. No. 4,146,495, issued Mar. 27, 1979 to Crutchfield et al, both incorporated herein by reference.

Citric acid is a highly preferred polycarboxylate builder.

NEUTRALIZATION SYSTEM

The present compositions can contain from about 0 to about 0.04 moles, preferably from about 0.01 to about 0.035 moles, more preferably from about 0.015 to about 0.03 moles, per 100 grams of composition of an alkanolamine selected from the group consisting of monoethanolamine, diethanolamine, triethanolamine, and mixtures thereof. Low levels of the alkanolamines, particularly monoethanolamine, are preferred to enhance product stability, detergency performance, and odor. However, the amount of alkanolamine should be minimized for best chlorine bleach compatibility. While the present compositions can contain mixtures of the alkanolamines, best color stability is obtained using single alkanolamines.

In addition, the compositions contain potassium and sodium ions in a potassium to sodium molar ratio of from about 0.1 to about 1.3, preferably from about 0.6 to about 1.

SOLVENT SYSTEM

The solvent system for the compositions is comprised of ethanol, a polyol and water. Ethanol is present at a level of from about 2% to about 10%, preferably from about 5% to about 9%, by weight of the composition.

Any polyol containing from 2 to 6 carbon atoms and from 2 to 6 hydroxy groups can be used in the present compositions. Examples of such polyols are ethylene glycol, propylene glycol and glycerine. Propylene glycol is particularly preferred. The polyol represents from about 2% to about 15%, preferably from about 3% to about 10%, by weight of the composition.

The compositions also contain from about 25% to about 40%, preferably from about 28% to about 37%, by weight of water.

In addition to the above, the ethanol and polyol together represent from about 8% to about 20%, preferably about 11% to about 16%, by weight of the composition. The ethanol, polyol and water should total from about 35% to about 55%, preferably about 40% to about 50%, by weight of the composition.

The compositions of the present invention are further constrained by the following limits, in which all percentages and ratios are calculated on an acid basis where anionic materials are involved. The sulfonate, alcohol ethoxylate sulfate, ethoxylated nonionic and quaternary ammonium, amine or amine oxide surfactants, together, represent from about 20% to about 35%, preferably from about 23% to about 30%, by weight of the composition. The weight ratio of the sulfonate surfactant to the alcohol ethoxylate sulfate surfactant should also be from about 0.3 to about 1.7, preferably from about 0.6 to about 1. The weight ratio of these anionic surfactants to the ethoxylated nonionic surfactant should also be from about 1 to about 10, preferably from about 2 to about 5.

The fatty acid and polycarboxylate builder together represent from about 8% to about 28%, preferably from about 13% to about 22%, by weight of the composition. In addition, the fatty acid, polycarboxylate builder and above surfactants represent a total of from about 33% to about 50%, preferably from about 36% to about 48%, by weight of the composition.

Finally, all of the above components are selected to provide an isotropic liquid detergent at 55° F. (12.8° C.), preferably at 50° F. (10° C.). The components are also selected to provide an initial pH of from about 7.5 to about 9.0, preferably from about 7.8 to about 8.8, at a concentration of 10% by weight in water at 68° F. (20° C.).

OPTIONAL COMPONENTS

Optional components for use in the liquid detergents herein include enzymes, enzyme stabilizing agents, polyacids, soil removal agents, antiredeposition agents suds regulants, hydrotropes, opacifiers, antioxidants, bactericides, dyes, perfumes, and brighteners described in the U.S. Pat. No. 4,285,841, Barrat et al, issued Aug. 25, 1981, incorporated herein by reference. Such optional components generally represent less than about 15%, preferably from about 2% to about 10%, by weight of the composition.

Enzymes are highly preferred optional ingredients and are incorporated in an amount of from about 0.025% to about 2%, preferably from about 0.05% to about 1.5%. Preferred proteolytic enzymes should provide a proteolytic activity of at least about 5 Anson units (about 1,000,000 Delft units) per liter, preferably from about 15 to about 70 Anson units per liter, most preferably from about 20 to about 40 Anson units per liter. A proteolytic activity of from about 0.01 to about 0.05 Anson units per gram of product is desirable. Other enzymes, including amylolytic enzymes, are also desirably included in the present compositions.

Suitable proteolytic enzymes include the many species known to be adapted for use in detergent compositions. Commercial enzyme preparations such as "Alcalase" sold by Novo Industries and "Maxatase" sold by Gist-Brocades, Delft, The Netherlands, are suitable. Other preferred enzyme compositions include those commercially available under the tradenames SP-72 ("Esperase") manufactured and sold by Novo Industries, A/S, Copenhagen, Denmark and "AZ-Protease" manufactured and sold by Gist-Brocades, Delft, The Netherlands.

Suitable amylases include "Rapidase" sold by Gist-Brocades and "Termamyl" sold by Novo Industries.

A more complete disclosure of suitable enzymes can be found in U.S. Pat. No. 4,101,457, Place et al, issued July 18, 1978, incorporated herein by reference.

When enzymes are incorporated in the detergent compositions of this invention, they are desirably stabilized by using a mixture of a short chain carboxylic acid salt and calcium ion, such as disclosed in U.S. Pat. No. 4,318,818, Letton et al, issued Mar. 9, 1982, incorporated herein by reference.

The short chain carboxylic acid salt is preferably water-soluble, and most preferably is a formate, e.g., sodium formate. The short chain carboxylic acid salt is used at a level from about 0.25% to about 10%, preferably from about 0.3% to about 3%, more preferably from about 0.5% to about 1.5%. Any water-soluble calcium salt can be used as a source of calcium ion, including calcium acetate, calcium formate and calcium propionate. The composition should contain from about 0.1 to about 30 millimoles of calcium ion per liter, preferably from about 0.5 to about 15 millimoles of calcium ion per liter. When materials are present which complex calcium ion, it is necessary to use high levels of calcium ion so that there is always some minimum level available for the enzyme.

Enzymes are preferably stabilized in the present compositions by the addition of from about 0.25% to about 10%, preferably from about 0.5% to about 5%, more preferably from about 0.75% to about 3%, by weight of boric acid or a compound capable of forming boric acid in the composition (calculated on the basis of the boric acid). Boric acid is preferred, although other compounds such as boric oxide, borax and other alkali metal borates (e.g., sodium ortho-, meta- and pyroborate, and sodium pentaborate) are suitable. Substituted boric acids (e.g., phenylboronic acid, butane boronic acid, and p-bromo phenylboronic acid) can also be used in place of boric acid.

The combination of boric acid and formate provides improved protease stability, although amylase stability appears to be slightly less than that obtained using boric acid alone.

Preferred compositions also contain from about 0.01% to about 1% of a polyacid or salt thereof, to enhance pretreatment performance. Preferred polyacids for use herein are ethylenediamine tetramethylenephosphonic acid, diethylene triamine pentamethylenephosphonic acid, and diethylenetriamine pentaacetic acid, or the salts thereof. These polyacids/salts are preferably used in an amount from about 0.1% to about 0.8%.

Preferred compositions herein further contain from about 0.5% to about 3%, preferably from about 1% to about 2%, by weight of a highly ethoxylated polyethyleneamine or polyethyleneimine soil removal and antiredeposition agent, such as those described in pending U.S. patent application Ser. No. 452,463, Vander Meer, filed Dec. 23, 1982. A particularly preferred material is tetraethylene pentaimine ethoxylated with about 15–18 moles of ethylene oxide at each hydrogen site.

The following examples illustrate the compositions of the present invention.

All parts, percentages and ratios used herein are by weight unless otherwise specified.

EXAMPLE I

Liquid detergent compositions of the present invention are as follows:

| Component | Wt. % A | Wt. % B |
|---|---|---|
| $C_{13}$ linear alkylbenzene sulfonic acid | 7.2 | 7.2 |
| $C_{14-15}$ alkyl polyethoxylate (2.25) sulfuric acid | 10.8 | 10.8 |
| $C_{12-13}$ alcohol polyethoxylate (6.5)* | 6.5 | 6.5 |
| $C_{12}$ alkyl trimethylammonium chloride | 1.2 | 0.6 |
| $C_{12-14}$ fatty acid | 13.0 | — |
| Oleic acid | 2.0 | — |
| Palm kernel fatty acid (stripped) | — | 15.0 |
| Citric acid (anhydrous) | 4.0 | 4.0 |
| Diethylenetriamine pentaacetic acid | 0.23 | 0.23 |
| Protease enzyme (2.0 AU/g) | 0.75 | 0.75 |
| Amylase enzyme (375 Am. U/g) | 0.16 | 0.16 |
| TEPA-$E_{15-18}$** | 1.5 | 1.5 |
| Monoethanolamine | 2.0 | — |
| (moles of alkanolamine) | (0.033) | (0) |
| Sodium ion | 1.66 | 2.75 |
| Potassium ion | 2.65 | 2.55 |
| (molar $K^+$:$Na^+$) | (0.94) | (0.55) |
| Propylene glycol | 6.8 | 5.0 |
| Ethanol | 7.8 | 8.5 |
| Formic acid | 0.66 | 0.66 |
| Calcium ion | 0.03 | 0.03 |
| Minors and water | Balance to 100 | |
| pH at concentration of 10% | 8.65 | 8.5 |

-continued

| Component | Wt. % A | Wt. % B |
|---|---|---|
| in water at 68° F. (20° C.) | | |

*Alcohol and monoethoxylated alcohol removed.
**Tetraethylene pentaimine ethoxylated with 15–18 moles (avg.) of ethylene oxide at each hydrogen site.

Composition A was prepared by adding the components, with continuous mixing, in the following order: paste premix of alkylbenzene sulfonic acid, sodium hydroxide, propylene glycol and ethanol; paste premix of alkyl polyethoxylate sulfuric acid, sodium hydroxide and ethanol; pentaacetic acid; alcohol polyethoxylate; premix of water, brighteners, alkanolamine, and alcohol polyethoxylate; ethanol; sodium and potassium hydroxide; fatty acid; citric acid; formic acid and calcium; alkyl trimethylammonium chloride; TEPA-$E_{15-18}$; adjust pH to about 8.1; and balance of components.

Composition B was prepared by adding the components, with continuous mixing, in the following order: paste premix of alkyl polyethoxylate sulfuric acid and ethanol; 2.5 parts water; propylene glycol; premix of ethanol and brightener; ethanol; premix of water, propylene glycol and brightener; alcohol polyethoxylate; sodium hydroxide; potassium hydroxide; fatty acid; alkylbenzene sulfuric acid; premix of citric acid and calcium; pentaacetic acid; formic acid; alkyl trimethylammonium chloride; TEPA-$E_{15-18}$; potassium hydroxide and water; and balance of components.

Compositions A and B were isotropic liquids as made and remained isotropic down to about 50° F. (10° C.). They also recovered to an isotropic form, after freezing and thawing, by about 55° F. (12.8° C.).

EXAMPLE II

The following liquid detergents of the invention were made using the same order of addition as for Composition A of Example I. The compositions were stable isotropic liquids at 55° F. (12.8° C.).

| Components | Wt. % A | Wt. % B | Wt. % C |
|---|---|---|---|
| $C_{13}$ linear alkylbenzene sulfonic acid | 7.5 | 10.5 | — |
| $C_{11.4}$ linear alkylbenzene sulfonic acid | — | — | 4.7 |
| $C_{14-15}$ alkyl polyethoxylate (2.25) sulfuric acid | 7.5 | 7.5 | — |
| $C_{12-14}$ alkyl polyethoxylate (1.0) sulfuric acid | — | — | 4.8 |
| $C_{12-13}$ alcohol polyethoxylate (6.5)* | 12.0 | 6.5 | 9.5 |
| $C_{12}$ alkyl trimethylammonium chloride | 1.2 | — | 1.2 |
| $C_{12-16}$ alkyl dimethyl amine oxide | — | 0.6 | — |
| $C_{12-14}$ fatty acid | 12.0 | 13.0 | 11.0 |
| Oleic acid | — | 2.0 | — |
| Citric acid | 3.0 | 4.0 | 5.0 |
| Diethylenetriamine pentaacetic acid | 0.23 | 0.23 | 0.23 |
| Protease enzyme (2.0 AU/g) | 0.75 | 0.75 | 0.75 |
| Amylase enzyme (375 Am. U/g) | 0.16 | 0.16 | 0.16 |
| TEPA-$E_{15-18}$** | 1.5 | 1.5 | 1.5 |
| Monoethanolamine | — | 1.0 | 2.2 |
| (moles of alkanolamine) | (0) | (0.016) | (0.036) |
| Sodium ion | 1.81 | 2.50 | 1.41 |
| Potassium ion | 2.58 | 2.58 | 2.58 |
| (molar $K^+$:$Na^+$) | (0.84) | (0.61) | (1.08) |
| Propylene glycol | 8.0 | 10.0 | 5.0 |
| Ethanol | 7.0 | 6.0 | 4.0 |

-continued

| Components | Wt. % A | B | C |
|---|---|---|---|
| Formic acid | 0.66 | 0.66 | 0.66 |
| Calcium ion | 0.038 | 0.038 | 0.038 |
| Minors and water | Balance to 100 | | |
| pH at concentration of 10% in water at 68° F. (20° C.) | 8.60 | 8.45 | 8.75 |

EXAMPLE III

The following liquid detergents of the invention were made using the same order of addition as for Composition A of Example I. The compositions were stable isotropic liquids at 50° F. (10° C.). They also recovered, after freezing and thawing, to an isotropic form by 50° F. (10° C.).

| Components | Wt. % A | B |
|---|---|---|
| $C_{13}$ linear alkylbenzene sulfonic acid | 8.0 | 8.0 |
| $C_{14-15}$ alkyl polyethoxylate (2.25) sulfuric acid | 12.0 | 12.0 |
| $C_{12-13}$ alcohol polyethoxylate (6.5)* | 5.0 | 5.0 |
| $C_{12}$ alkyl trimethylammonium chloride | 0.6 | 0.6 |
| $C_{12-14}$ fatty acid | 10.0 | 7.7 |
| Oleic acid | 0.5 | — |
| Palm kernel fatty acid | — | 3.3 |
| Citric acid | 4.0 | 4.0 |
| Diethylenetriamine pentaacetic acid | 0.23 | 0.23 |
| Protease enzyme (2.0 AU/g) | 0.75 | 0.75 |
| Amylase enzyme (375 Am. U/g) | 0.16 | 0.16 |
| TEPA-$E_{15-18}$** | 2.0 | 2.0 |
| Monoethanolamine | 2.0 | 2.0 |
| (moles of alkanolamine) | (0.033) | (0.033) |
| Sodium ion | 2.53 | 2.53 |
| Potassium ion | 1.11 | 1.11 |
| (molar $K^+$:$Na^+$) | (0.26) | (0.26) |
| Propylene glycol | 3.5 | 3.5 |
| Ethanol | 8.5 | 8.5 |
| Formic acid | 0.08 | 0.08 |
| Boric acid | 1.25 | 1.25 |
| Calcium ion | 0.03 | 0.03 |
| Minors and water | Balance to 100 | |
| pH at concentration of 10% in water at 68° F. (20° C.) | 8.45 | 8.45 |

What is claimed is:

1. A heavy-duty liquid detergent composition comprising, by weight:

(a) from about 5% to about 15%, on an acid basis, of a sulfonate surfactant containing a $C_{10}$–$C_{16}$ alkyl or alkenyl group;

(b) from about 8% to about 18%, on an acid basis, of an alcohol ethoxylate sulfate surfactant of the formula $RO(C_2H_4O)_mSO_3M$, wherein R is a $C_{10}$–$C_{16}$ alkyl or hydroxyalkyl group, m is from about 0.5 to about 4, and M is a compatible cation;

(c) from about 2% to about 15% of an ethoxylated nonionic surfactant of the formula $R^1(OC_2H_4)_nOH$, wherein $R^1$ is a $C_{10}$–$C_{16}$ alkyl group or a $C_8$–$C_{12}$ alkyl phenyl group, n is from about 3 to about 9, and said nonionic surfactant has an HLB of from about 10 to about 13;

(d) from about 0% to about 5% of a cosurfactant selected from the group consisting of:

(i) quaternary ammonium surfactants having the formula:

$$[R^2(OR^3)_y][R^4(OR^3)_y]_2R^5N^+X^-$$

wherein $R^2$ is an alkyl or alkyl benzyl group having from about 6 to about 16 carbon atoms in the alkyl chain; each $R^3$ is selected from the group consisting of —$CH_2CH_2$—, —$CH_2CH(CH_3)$—, —$CH_2CH(CH_2OH)$—, —$CH_2CH_2CH_2$—, and mixtures thereof; each $R^4$ is selected from the group consisting of $C_1$–$C_4$ alkyl, $C_1$–$C_4$ hydroxyalkyl, benzyl, and hydrogen when y is not 0; $R^5$ is the same as $R^4$ or is an alkyl chain wherein the total number of carbon atoms of $R^2$ plus $R^5$ is from about 8 to about 16; each y is from 0 to about 10 and the sum of the y values is from 0 to about 15; and X is any compatible anion;

(ii) amine surfactants having the formula:

$$[R^2(OR^3)_y][R^4(OR^3)_y]R^5N$$

wherein $R^2$, $R^3$, $R^4$, $R^5$ and y are as defined above;

(iii) amine oxide surfactants having the formula:

$$[R^2(OR^3)_y][R^4(OR^3)_y]R^5N\rightarrow 0$$

wherein $R^2$, $R^3$, $R^4$, $R^5$ and y are as defined above;

(e) from about 5% to about 20% of a $C_{10}$–$C_{14}$ saturated fatty acid, the weight ratio of $C_{10}$–$C_{12}$ fatty acid to $C_{14}$ fatty acid being at least 1;

(f) from about 3% to about 8%, on an acid basis, of a water-soluble polycarboxylate builder material;

(g) from about 0 to about 0.04 moles per 100 grams of composition of an alkanolamine selected from the group consisting of monoethanolamine, diethanolamine and triethanolamine;

(h) potassium and sodium ions in a potassium to sodium molar ratio of from about 0.1 to about 1.3;

(i) from about 2% to about 10% ethanol;

(j) from about 2% to about 15% of a polyol containing from 2 to 6 carbon atoms and from 2 to 6 hydroxy groups; and (k) from about 25% to about 40% water;

said composition containing from about 20% to about 35% of (a), (b), (c) and (d); from about 8% to about 28% of (e) and (f); from about 33% to about 50% of (a), (b), (c), (d), (e) and (f); from about 8% to about 20% of (i) and (j); and from about 35% to about 55% of (i), (j) and (k); the weight ratio of (a) to (b) being from about 0.3 to about 1.7; the weight ratio of (a) plus (b) to (c) being from about 1 to about 10; and all of said components being selected to provide an isotropic liquid at 55° F. (12.8° C.) having an initial pH of from about 7.5 to about 9.0 at a concentration of about 10% by weight in water at 68° F. (20° C.).

2. The composition of claim 1 wherein the sulfonate surfactant is a $C_{11}$–$C_{13}$ linear alkylbenzene sulfonate; in the alcohol ethoxylate sulfate surfactant, R is a $C_{12}$–$C_{15}$ alkyl group and m is from about 1.5 to about 3; and in the ethoxylated nonionic surfactant, R is a $C_{12}$–$C_{14}$ alkyl group and n is from about 3 to about 7.

3. The composition of claim 1 comprising from about 0.5% to about 1.5% of the cosurfactant, which is a $C_{10}$–$C_{14}$ alkyl trimethylammonium chloride, bromide or methylsulfate.

4. The composition of claim 1 wherein the polycarboxylate builder is citric acid.

5. The composition of claim 1 comprising from about 0.01 to about 0.035 moles per 100 grams of composition of the alkanolamine, which is monoethanolamine.

6. The composition of claim 2 comprising from about 6% to about 10% of the sulfonate surfactant, from about 9% to about 14% of the alcohol ethoxylate sulfate surfactant, from about 4% to about 10% of the ethoxylated nonionic surfactant, and from about 0.5% to about 1.5% of the cosurfactant, which is a $C_{10}$–$C_{14}$ alkyl trimethylammonium chloride, bromide or methylsulfate.

7. The composition of claim 6 comprising from about 10% to about 16% of the saturated fatty acid and from about 3% to about 6% of the polycarboxylate builder, which is citric acid.

8. The composition of claim 7 comprising from about 0.01 to about 0.035 moles per 100 grams of composition of the alkanolamine, which is monoethanolamine.

9. The composition of claim 8 comprising from about 5% to about 9% of ethanol, from about 3% to about 10% of the polyol, which is propylene glycol, and from about 28% to about 37% of water.

10. The composition of claim 9 having an initial pH of from about 7.8 to about 8.8 at a concentration of 10% by weight in water at 68° F. (20° C.).

* * * * *